United States Patent [19]

Fite

[11] 3,937,954

[45] *Feb. 10, 1976

[54] METHODS AND APPARATUS FOR SPATIAL SEPARATION OF AC AND DC ELECTRIC FIELDS, WITH APPLICATION TO FRINGE FIELDS IN QUADRUPOLE MASS FILTERS

[75] Inventor: Wade L. Fite, Pittsburgh, Pa.

[73] Assignee: Extranuclear Laboratories, Inc., Pittsburgh, Pa.

[ * ] Notice: The portion of the term of this patent subsequent to Feb. 18, 1992, has been disclaimed.

[22] Filed: Aug. 30, 1974

[21] Appl. No.: 502,158

Related U.S. Application Data

[63] Continuation-in-part of Ser. No. 346,250, March 30, 1973, Pat. No. 3,867,632.

[52] U.S. Cl. ..... 250/282; 250/292

[51] Int. Cl.[2] ..... H01J 39/34

[58] Field of Search ..... 250/292, 281, 282, 283

[56] References Cited

UNITED STATES PATENTS

| | | | |
|---|---|---|---|
| 3,129,327 | 4/1964 | Brubaker | 250/292 |
| 3,350,559 | 10/1967 | Young | 250/292 |
| 3,501,630 | 4/1970 | Brubaker | 250/292 |
| 3,617,736 | 11/1971 | Barnett | 250/292 |
| 3,783,279 | 1/1974 | Brubaker | 250/292 |
| 3,867,632 | 2/1975 | Fite | 250/292 |

*Primary Examiner*—Craig E. Church

*Attorney, Agent, or Firm*—Mason, Mason & Albright

[57] ABSTRACT

Methods and apparatus for spatially separating AC and DC electric fringe fields near the ends of quadrupole mass filters which involve use of materials with electric properties that function as dielectrics to the AC fields and as conductors to the DC fields. Devices constructed of such materials shield against DC fringe fields, but not against AC fringe fields. Such devices include a small shield in the form of a tube or other appropriate configuration disposed coaxially with the axis of the mass filter at either or both ends thereof. A good dielectric is used as the supporting structure and a thin conductive or semi-conductive layer is applied thereto which functions as the shield.

30 Claims, 7 Drawing Figures

METHODS AND APPARATUS FOR SPATIAL SEPARATION OF AC AND DC ELECTRIC FIELDS, WITH APPLICATION TO FRINGE FIELDS IN QUADRUPOLE MASS FILTERS

RELATED APPLICATION

This is a continuation-in-part application of my copending application Ser. No. 346,250 filed Mar. 30, 1973 now U.S. Pat. No. 3,867,632.

BACKGROUND OF THE INVENTION

My copending patent application Ser. No. 346,250 describes methods and apparatus for the spatial separation of high frequency AC electric fields of the order of $10^6$ Hz from low frequency, including DC, electric fields. The method disclosed involves the use of materials with a ratio of electrical conductivity to dielectric constant whereby the material functions as a conductor to low frequency, including DC, fields and as a dielectric material to high frequency AC fields.

The invention was applied to the problem of the spatial separation of the AC and DC fringe fields near the ends of a quadrupole mass filter. As indicated by W. M. Brubaker in U.S. Pat. No. 3,129,327, providing for the AC fringe fields to extend farther away from the mass filter ends than the DC fringe fields keeps the ions entering into the mass filter on stable trajectories. Brubaker teaches a method involving metallic electrodes on which only AC potentials are placed, as opposed to both AC and DC potentials that are applied to the four rods of the quadrupole mass filter structure, as a means to separate the fringe fields.

My copending patent application Ser. No. 346,250 discusses the theory of electric fields in imperfect, or leaky, dielectrics in a general way and demonstrates theoretically and experimentally that materials with a suitable ratio of conductivity to dielectric constant can be used to shield against DC electric fields while not shielding (at least completely, depending on the specific material used) against AC fields. Among the embodiments of the invention disclosed therein is a tube constructed of such a material, which is placed coaxially with the axis of the quadrupole mass filter and located such that one end of the tube extends preferably a short distance into the space between the four rods of the filter with the other end extending away from this space.

The present application considers the theory of such devices, as applied to tubular form, to derive the fundamental physical requirements on devices which are of a tubular form, and further discloses the use of heterogeneous devices; that is, devices made up of several materials.

THEORY AND SUMMARY OF THE INVENTION

The quadrupole mass filter comprises four parallel electrically conducting rods or hyperbolic cylindrical sheets, located at equal distances from the axis of the mass filter and at angles of 90° spaced about a circle centered on the axis of the mass filter. Opposite rods, i.e., those at 0° and 180°, are electrically connected together, as are those located at 90° and 270°. A potential difference is placed between the two rods at 0° and 90° which is a combination of AC and DC fields of the form 2 (U+Vcos$\omega$t), where U is a DC voltage and V is the amplitude of an AC voltage which has an angular frequency $\omega$, where $\omega=2\pi f$ and $f$ is the frequency. It is common practice to arrange the circuit common of the circuitry providing this difference of potential so that each rod has a potential with respect to the circuit common of one half the value given above, whereby two opposite rods have a potential with respect to the circuit common of U+Vcos$\omega$t and the other two opposite rods have a potential with respect to the circuit common of −(U+Vcos$\omega$t)

At any point in the space between the four rods there is a potential given by:

$$\phi\,(r,\theta,t) = (U + V\cos\omega t)\,\frac{r^2}{r_o^2}\cos 2\theta \qquad (1)$$

where $r$ and $\theta$ describe the location of any point in the space between the rods and $r_o$ is the distance from the axis of the mass filter to the nearest point on any rod (see FIG. 1). This field has both DC and AC components.

As is indicated by Brubaker, it is desirable for stability of trajectories of ions entering the mass filter to have only AC fields present in the fringe fields near the ends of the mass filter. This, as disclosed in copending application Ser. No. 346,250, may be accomplished by the placing in the fringe fields a tube of material which appears as a dielectric to the AC fringe fields but as a conductor to the DC fringe fields. Within the tube only the AC fringe fields are present, the tube material acting as a shield against the DC fringe fields.

A two dimensional problem is considered sufficient to ascertain the physical characteristics of such a tube as concerns its physical dimensions and the electrical properties of the tube material.

FIG. 1 thus diagrammically illustrates a section taken proximate the ends of the rods of a quadrupole mass filter with the tube in place. The relevant parameters are the inscribed circle radius $r_o$, the inside diameter of the tube $a$, and the outside diameter of the tube $b$. Tube 10 is composed of a material with an electrical conductivity $\sigma$ and a dielectric constant $\epsilon_1$. The four rods 11 are made of metal or another conductor and are interconnected electrically as previously indicated. The space not occupied by tube 10 or rods 11 is under vacuum and has a dielectric constant value of $\epsilon_o=1$.

According to Maxwell's equations, (see for Example, J. D. Jackson, "Classical Electrodynamics" John Wiley and Sons, 1962, Chapter 4), the potential, $\phi$, must satisy the equation:

$$\nabla^2\phi = 0 \qquad (2)$$

in the three regions: (1) outside the tube, (2) in the material of the tube and (3) inside the tube. Furthermore, continuity conditions at the surfaces at $r=a$ and $r=b$ require that: (1) $\delta\phi/\delta\theta$ and (2) $\epsilon\,\delta\phi/\delta r$ have the same values on either side of any surface. An additional condition is that at distances from the axis which approach infinity, the field is a pure hyperbolic field, i.e., the asymptotic solution must be given by:

$$\phi = Ar^2\cos 2\theta \qquad (3)$$

The solution to this problem in the three spatial regions gives:

$r > b$ (outside the tube)

$$\phi = A\left(r^2 - \frac{(\epsilon_i^2 - 1)}{D}\,\frac{(b^4 - a^4)}{r^2}\right)\cos 2\theta \qquad (4a)$$

$a < r < b$ (in the tube material)

$$\phi = A\left(\frac{2(\epsilon_i+1)}{D}r^2 + \frac{2(\epsilon_i-1)}{D}\frac{a^4}{r^2}\right)\cos 2\theta \quad (4b)$$

$r < a$ (inside the tube)

$$\phi = A\frac{4\epsilon_i}{D}r^2\cos 2\theta \quad (4c)$$

where $$D = (\epsilon_i+1)^2 - \frac{a^4}{b^4}(\epsilon_i-1)^2$$

Either by making the tube wall of vanishingly small thickness (i.e., $b = a$) or by making the electric constant of the tube equal to unity, which is mathematically equivalent to saying that no tube is present, the field in all three regions is given by $$\phi = Ar^2\cos 2\theta \quad (5)$$

which is a pure hyperbolic field. With the tube in place, the field outside the tube is distorted, but within the tube the field is pure hyperbolic with a strength that is given by $4\epsilon_1/D$ times the strength that would be present if the tube were not in place.

The mathematical formalism above is of the type usually used to describe cases where the materials are pure dielectrics, i.e., having a conductivity of zero, and where the dielectric constant is mathematically a purely real number. However, as will be appreciated by those acquainted with electromagnetic theory, the same formalism may be applied to conducting materials, having both a dielectric constant and a non-zero conductivity, in the presence of sinusoidally time-varying potentials. The only requirement is to replace the purely real dielectric constant by a complex dielectric constant:

$$\epsilon_c = \epsilon_i + i\frac{4\pi\sigma}{\omega} = \epsilon_i(1+i\alpha) \quad (6)$$

where $i = \sqrt{-1}$, $\sigma$ is the conductivity, $\omega$ is the angular frequency of the sinusoidally time-varying potential and $\alpha = 4\pi\sigma/\epsilon_1\omega$.

The potential inside such a conducting tube is given from equation (4c) as:

$$\phi = A\frac{4\epsilon_i(1+i\alpha)}{(\epsilon_i+1+i\epsilon_i\alpha)^2 - \frac{a^4}{b^4}(\epsilon_i-1+i\alpha\epsilon_i)^2}r^2\cos 2\theta \quad (7)$$

It is convenient to rewrite equation (7) as:

$$\phi = Br^2\cos 2\theta \quad (8)$$

Then the ratio, B/A, is the amplitude of the potential inside of the tube relative to the amplitude of the potential that would be at the same position if the tube were not in place. From equations (7) and (8), the quantity of interest is:

$$B/A = \frac{4\epsilon_i(1+i\alpha)}{(\epsilon_i+1+i\alpha\epsilon_i)^2 - \frac{a^4}{b^4}(\epsilon_i-1+i\alpha\epsilon_i)^2} \quad (9)$$

First to be noted is that if $\alpha << 1$, equation (9) reduces to:

$$B/A = \frac{4\epsilon_i}{(\epsilon_i+1)^2 - \frac{a^4}{b^4}(\epsilon_i-1)^2} \quad (10)$$

which is the equation governing the situation discussed in my copending patent application Ser. No. 346,250. It may be noted that if the interior radius $a$ of tube 10 is one-half the exterior diameter $b$ of the tube and if the dielectric constant is of the order of 10, equation (10) indicates that B/A = 0.345, which is to say that the potential at any point inside the tube would be about one third as large as it would be if the tube were not present.

It may also be noted that if $\alpha >> 1$ equation (9) reduces to:

$$\frac{B}{A} = \frac{4i}{-\alpha\epsilon_i} \times \frac{b^4}{b^4-a^4} \quad (11)$$

In the event that the frequency is zero (i.e., DC potentials), $\alpha$ becomes infinitely large and B takes on the value of zero. Thus fields of DC potentials are completely shielded out by a tube of any material with non-zero conductivity.

Of particular interest to the present application is the "thin wall approximation," where a is only slightly less than $b$. Calling $T = b - a$, which is the wall thickness, the thin wall approximation is that $T/b << 1/\epsilon_1$ or $\epsilon_1 T/b << 1$. By conventional mathematical means it can be shown that under these circumstances and for $\epsilon_1 \approx 1$ equation (9) reduces to:

$$\frac{B}{A} \cong \frac{1+i\alpha}{1+i\alpha-\epsilon_i\frac{T}{b}\alpha^2} \quad (12)$$

In this approximation, if $\alpha << 1$, B/A=1. Further if $\alpha \approx 1$, B/A is still equal to very nearly 1, since the third term in the denominator is vanishingly small. In the event that $\alpha >> 1$, equation (10) becomes $$\frac{B}{A} = \frac{\alpha}{\alpha+i\epsilon_i\frac{T}{b}\alpha^2} = \frac{1}{1+i\epsilon_i\frac{T}{b}\alpha} \quad (13)$$

The quantity of real interest in the present instance is the ratio of the absolute values of B to A, which may be found by taking the square root of the product of B/A times its complex conjugate. This ratio of absolute values is:

$$\frac{|B|}{|A|} = \frac{1}{\sqrt{1+\left(\epsilon_i\frac{T}{b}\alpha\right)^2}} \quad (14)$$

In order to have the potential inside the tube be a substantial fraction of the potential that would be there if the tube were absent, the condition is:

$$\epsilon_i\frac{T}{b}\alpha \lesssim 1$$

or $$\frac{T}{b} \lesssim \frac{1}{\alpha\epsilon_i} = \frac{\omega}{4\pi\sigma} = \frac{f}{2\sigma} \quad (15)$$

This condition is the design criterion for a tubular field separator having a thin wall. It may be noted that metallic conductors have conductivities in the units used in this analysis of about $10^{17}$ $sec^{-1}$. For a time-varying potential having a frequency $f$ of $10^6$ Hz, the requirement from equation (15) is that the wall thickness must be about $5 \times 10^{-12}$ times the radius to the wall. For tubes with a radius of the order of a centimeter or less, the wall thickness of the conductor would have to be less than one-thousandth of the dimensions of an atom. Thus solid ordinary conducting materials cannot be used for the separation of the AC and DC fields.

It is to be noted, however, that thin layers of conducting and semi-conducting materials can be used, provided that they are not solid; for example, a layer of material consisting of solid particles just barely making electrical contact, may suffice. In this connection it is interesting to determine the requirement and to do this it is convenient to use the commonly used concept of surface conductivity. The surfaces conductivity $s$ is related to the volume conductivity $\sigma$ by:

$$s = \sigma T \quad (16)$$

Substituting equation (16) into equation (15) and converting from cgs units to practical units, the requirement for shielding against electric fields of DC potentials while transmitting fractionally AC potentials at a frequency $f$ is:

$$R_s \text{ (ohms/square)} \approx \frac{1.8 \cdot 10^{12}}{b \cdot f} \quad (17)$$

Thus for fields at a frequency of $10^6$ Hz, and for a tube with a radius of 0.5 cm, the surface resistivity desired is of the order of $4 \times 10^6$ ohms/square. Such surfaces resistivities can be produced on dielectric substrates.

It may be noted that if such a surface is produced on the interior of a dielectric tube, it is necessary to measure the surface resistivity. This may be accomplished easily by measuring the resistance R over the length of the tube. The total resistance is given by:

$$R = R_s \frac{2\pi b}{L} \quad (18)$$

where L is the length of the tube. For a tube with a surface resistivity $R_s = 4 \times 10^6$ ohms/square, a radius of 0.5 cm and a length of 2 cm, the total resistance is about $5 \times 10^6$ ohms. Thus by simply measuring the resistance of a tube with an interior surface coating, it is easily determined whether the tube will separate the DC and AC fields in the manner given in the theory.

DESCRIPTION OF THE PREFERRED EMBODIMENTS

Devices of homogeneous material for the separation of AC and DC fields near the ends of a quadrupole mass filter are described in my copending patent application Ser. No. 346,250. The essential characteristic of the material is that it must react to high frequency AC fields as a dielectric and to low frequency, including direct current, fields as a conductor. Such materials which are operable are known as "leaky dielectrics" in contrast with good dielectrics which have resistivities of $10^{12}$ ohm-cm and higher. A dielectric is considered leaky when its resistance is such that leakage current flows. For the purpose of the instant invention, this generally covers resistivities from greater than about $10^5$ ohm-cm to less than about $10^{11}$ ohm-cm. The practical upper limits of the resistivity insofar as a quadrupole mass filter is concerned relate to the sweep rate as will be understood by those skilled in the art having the teachings of the instant and parent applications before them. As a practical matter, the upper limit to the sweep of the mass filter is about 1,000 Hz and in the context of quadrupole mass filter operations this is considered to be a low frequency. For such frequency, theoretically the material involved should have a resistivity of about $3 \times 10^6$ ohm-cm. However, as a practical matter, materials having resistivities up to about $10^8$ ohm-cm are operable even at the maximum sweeping rate for the quadrupole mass filter. By reducing the sweeping rate to about 10 Hz, materials with resistivities up to about $10^{10}$ ohm-cm are operable. Materials which have been found operable include Ceramag C/12 and Ceramag C/11 which are manufactured by the Stackpole Carbon Company of St. Marys, Pa. These materials are known as ferrites and basic formula for same is set forth in U.S. Pat. No. 3,036,009. In addition, a tube composed of slate having a resistivity of about $10^6$ ohm-cm has been tested and found operable. Each of the foregoing materials was generally homogenous in composition. The present continuation-in-part application relates to the use of selective shielding devices which are not of homogeneous constitution but instead comprised of a thin layer of conductive material deposited on the surfaces of good dielectric materials with such dielectric material used in part to provide mechanical strength. As evident from the theory discussed above, the presence of a dielectric tube, if very thin or if the dielectric constant of the tube is not appreciably greater than unity, the fields within the tube are affected only slightly.

Figure 2:
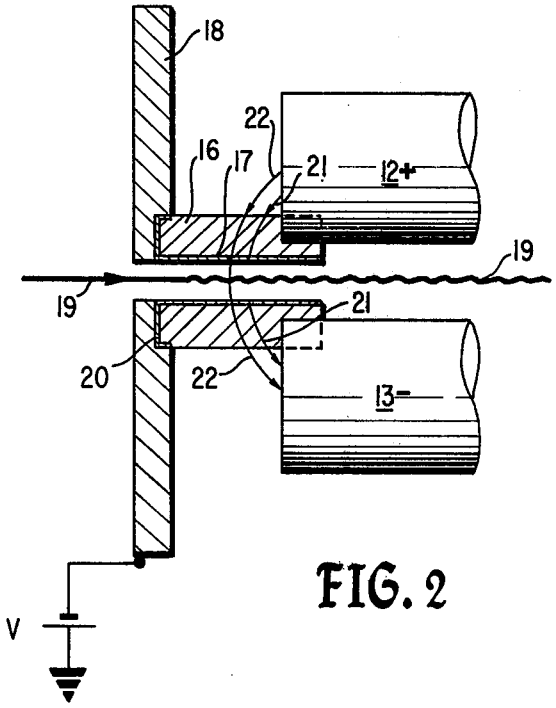
FIG. 2 is a side elevation sectional view similar to FIG. 1 illustrating the effect of the invention on the fringe fields of the mass filter.
Figure 3:
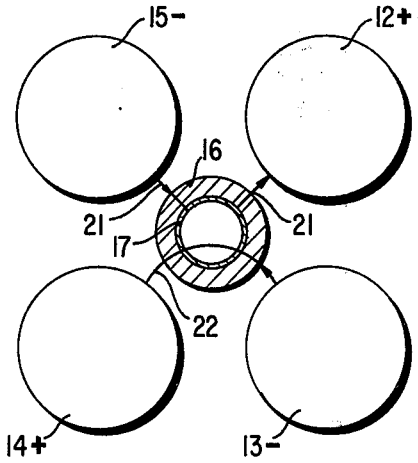
FIG. 3 is a front elevational view similar to FIG. 2.

FIGS. 2 and 3 show a preferred embodiment of the invention. Inserted slightly into the space between the four rods of a quadrupole mass filter, 12, 13, 14, and 15 is a dielectric tube 16 with an interior surface coating 17 which is electrically conducting. The end surface 20 of tube 16 is also electrically conducting and is in electrical contact with a conducting end plate 18 which is connected to ground through a bias potential, v. Ions from an ion source, which follow a trajectory indicated by reference numeral 19 in the figure, pass through an aperture in the end plate 18, proceed along the axis within the tube 16 and enter the mass filter proceeding along its axis. The figure also shows the DC electrical field lines, a typical one being designated 21, which terminate on the conducting coating of interior surface 17 of tube 16; the AC field lines, a typical one of which is designated as 22 do not, on the other hand, completely terminate on the conducting coating of interior surface 17 but penetrate such coating 17 and are present within the interior of tube 16.

Figure 1:
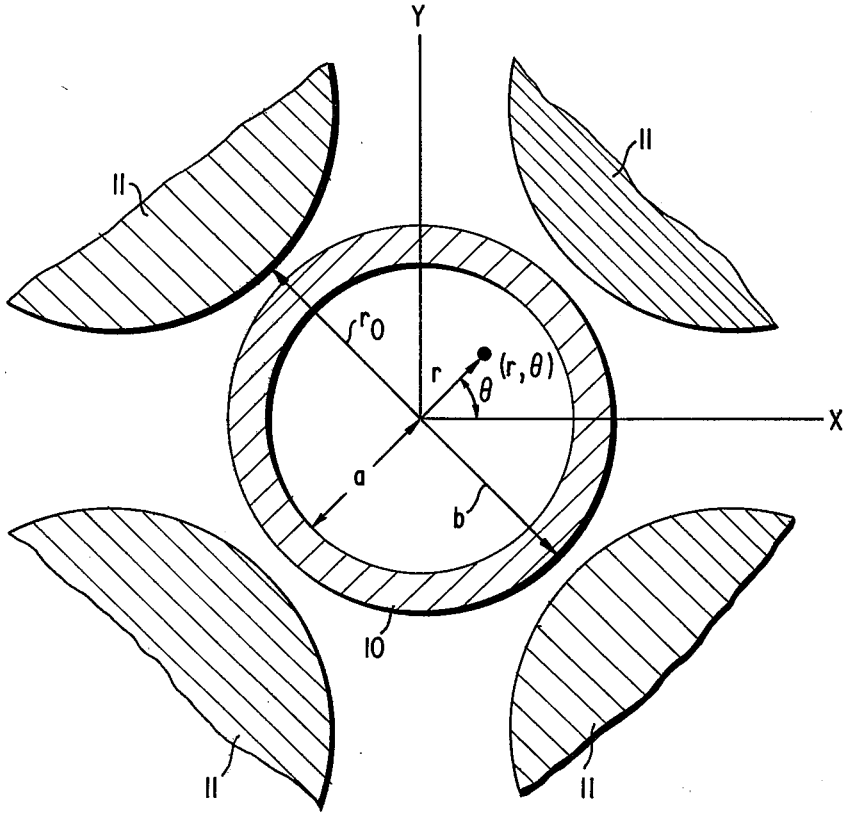
FIG. 1, as previously described in an explanation of the theory of the invention, diagrammatically illustrates a section of the rods of a quadrupole mass filter with a tube in accordance with the invention inserted between the rods proximate their ends.

In one test of the invention, tube 16 was composed of ceramic alumina ($Al_2O_3$) of 1 inch length and inside and outside diameters of ⅜ inch and ½ inch respectively. A suspension of colloidal graphite (sold by Graphite Products Corporation of Brookfield, Ohio, as "Aquadag") was further diluted in water by a factor of about twenty to one. The diluted substance was applied to the interior of the tube, lightly wiped off by a cotton-wool swab and allowed to dry to form conducting coating 17. One end of tube 16 was thereafter dipped into the colloidal graphite suspension and a thick layer comprising end surface 20 formed upon drying. Tube 16, so constructed had an over-all resistance from end to end of $1.7 \times 10^6$ ohms. Tube 16, mounted on an end plate 18 of a quadrupole mass filter (Extranuclear Model 324-9) as shown in FIGS. 1 – 3 proved operable as described to separate the AC and DC electric fringe fields proximate the end of the mass filter.

Those skilled in the art, in view of the discussion presented herein, will understand that if the material of the conducting coating has sufficiently low conductivity (i.e., $\alpha << 1$ at the high frequency used) and sufficient mechanical strength to support its own weight then the dielectric tube 16 can be eliminated and the invention is a homogeneous device as disclosed in my copending application Ser. No. 346,250.

Figure 4:
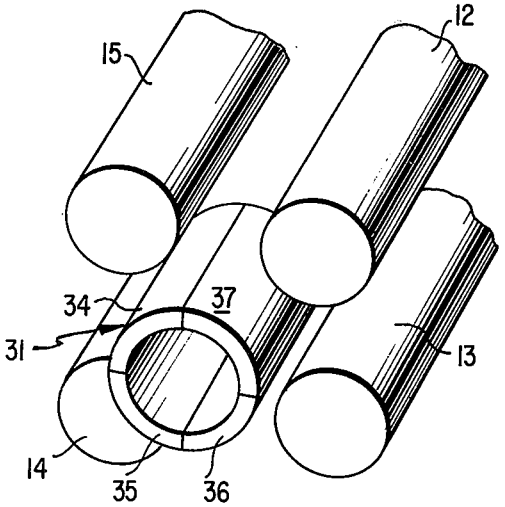
FIG. 4 illustrates in perspective a tube insert in accordance with the invention wherein the tube comprises four separate pieces.
Figure 4A:
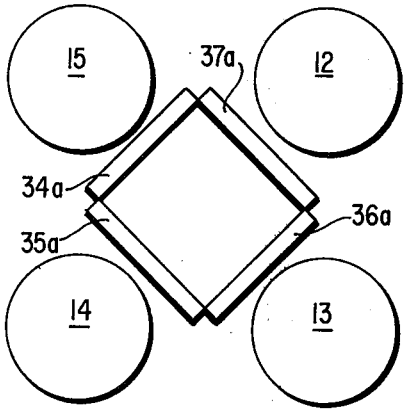
FIG. 4*a* is a front elevational view of four separate strips located parallel around a circle to form a tube in accordance with the invention.
Figure 5:
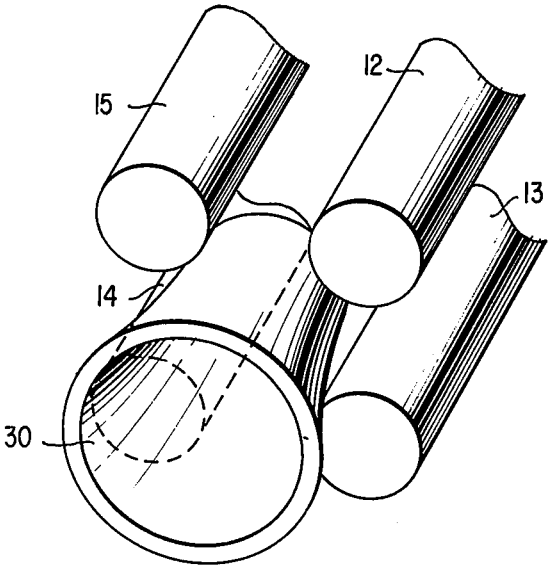
FIG. 5 illustrates in perspective a tube insert in accordance with the invention wherein the tube insert is funnel shaped.
Figure 6:
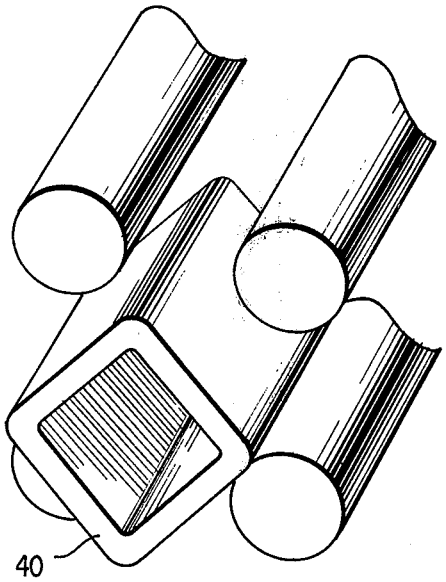
FIG. 6 illustrates in perspective a tube insert which has a rectangular cross-section and opening.

It is also to be appreciated by those skilled in the art that other forms than the tubular form shown in FIGS. 2 and 3 are effective embodiments of the invention. Shapes that are operable include cones such as cone 30 in FIG. 5, preferably with the apex of the cone directed toward the mass filter with the axis of the cone co-axial with the axis of the mass filter. Also, as shown in FIG. 6, tubes 40 similar to the tubes discussed above, but with rectangular or other cross-sectional configurations may be used. Further devices may be comprised of more than one piece of material or materials. As an example, a device as shown in FIG. 4 comprising a tube 31 split along its length into four pieces 34, 35, 36 and 37 and then mounted substantially as shown in FIG. 4 serves to permit the high frequency AC fields to penetrate into the space surrounded by the four pieces of the split tube 31, while serving to shield the same space from the penetration of DC and low frequency AC fields. Similarly, in such an embodiment, it is not necessary that the four pieces 34, 35, 36 and 37 of material be from a tube split along its length. Thus four strips of material 34*a*, 35*a*, 36*a* and 37*a* placed parallel to each other, spaced around a circle as viewed from the ends of the four strips, and located such that the spacing between the strips is very small compared to the width of the strips as shown in FIG. 4*a*, will equally effect the separation of the high frequency AC potentials from the DC and low frequency AC fields, by excluding the penetration of the DC fields from the region between the four strips.

Other configurations of materials will be readily apparent to those skilled in the art.

Equally apparent is the fact that a thin conducting layer can be produced by means other than disclosed herein where granular carbon particles made up the layer. For example, known means of producing conducting layers on glass can be used to produce the devices described herein, such means including spraying solutions of tin oxides and other compounds on to hot glass.

Having thus described my invention, what I claim as new and desire to secure by Letters Patent of the United States is:

1. In a method for the spatial separation of the high frequency AC fringe fields and low frequency AC, including DC, fringe fields, near the ends of a quadrupole mass filter, the use of field separation means which includes a material which responds to the high frequency AC fields substantially as a dielectric and responds to the low frequency AC, including DC, fields substantially as a conductor of electricity.

2. A method in accordance with claim 1, wherein said field separation means is physically located to provide a region proximate the end of a quadrupole mass filter which is substantially surrounded thereby, provision being made for openings therein to permit ions from an ion source to enter the substantially surrounded region and then to leave said region and pass on into the quadrupole mass filter.

3. Apparatus for the spatial separation of high frequency AC fringe fields and low frequency AC, including DC, fields near an end of a quadrupole mass filter comprising separation means composed of a material which responds to high frequency AC fields substantially as a dielectric and responds to low frequency AC, including DC, fields substantially as a conductor of electricity, separation means having a form whereby it has an axis which is coaxial with the axis of the quadrupole mass filter, one end of said separation means being located within the region between the four poles of the quadrupole mass filter and the other end of said separation means being located outside said region between the four poles of the quadrupole mass filter.

4. Apparatus in accordance with claim 3 wherein said separation means has the form of a tube.

5. Apparatus in accordance with claim 4, wherein said tube is constructed of a substantially homogeneous material having a volume resistivity in excess of about $10^5$ ohm-cm and less than about $10^{11}$ ohm-cm.

6. Apparatus in accordance with claim 3, wherein said separation means comprises several pieces of said material.

7. Apparatus in accordance with claim 6 in which said pieces have volume resistivities in excess of about $10^5$ ohm-cm to less than about $10^{11}$ ohm-cm.

8. Apparatus in accordance with claim 3, wherein said material comprises a thin conducting layer applied to the surface of a good dielectric material.

9. Apparatus in accordance with claim 8, wherein said layer from end to end has a resistance in a range of $10^5$ to $10^{11}$ ohms.

10. Apparatus in accordance with claim 9, wherein said resistance is in a range of $10^6$ to $10^8$ ohms.

11. Apparatus in accordance with claim 8, wherein said layer comprises carbon.

12. Apparatus in accordance with claim 8, wherein said separation means is in the form of a tube.

13. Apparatus in accordance with claim 12, wherein said good dielectric material forms said tube together with said layer which comprises an interior coating on said dielectric material.

14. A device for improving the efficiency of injection and/or transmission of ions passing through quadrupole mass filters, said device comprising a tube inserted from at least one of the ends along the axis and into the space between the four electrodes of the mass filter whereby ions passing through said space transit through said filter, the end of said tube directed away from the mass filter being electrically connected to a predetermined potential, said tube being composed of a good dielectric and having a thin coating of an electrically conducting material which is such that it functions substantially as a high dielectric to the high AC fields of a quadrupole mass filter and substantially as an electrical conductor to the low AC and DC fields of the mass filter.

15. A device in accordance with claim 14 wherein said tube is inserted into the entrance end of said space between the four electrodes and the mass filter.

16. A device in accordance with claim 14 wherein said tube is substantially cylindrical in form.

17. A device in accordance with claim 14 wherein said tube is substantially in the form of a truncated cone.

18. A device in accordance with claim 14 wherein said layer of electrically conducting material is in the interior portion of said tube.

19. A device in accordance with claim 18 wherein said material has a resistance in the range of about $10^5$ to $10^{10}$ ohms.

20. A device for improving the efficiency of injection and/or transmission of ions passing through a quadrupole mass filter, said device comprising at least two separated pieces which are symmetrically disposed about the axis of the mass filter to receive between them ions that travel through the mass filter each said piece being composed of a material which is a good dielectric and a thin layer of electrically conducting material thereon, said thin layer of material being characterized by functioning substantially as a conductor to the low AC and DC fields and as a good dielectric to the high AC fields of the mass filter whereby said layer causes the high AC fringe fields of the mass filter to extend relatively farther away from at least one end of the mass filter than the low AC and DC fringe fields.

21. A device in accordance with claim 20 which comprises four pieces, each of said pieces being adjacent and parallel to a pole of the quadrupole mass filter.

22. A device in accordance with claim 21 wherein said pieces are substantially planar.

23. A device in accordance with claim 21 wherein said pieces are curved in cross section.

24. In a method of mass analysis which utilizes a quadrupole mass filter and comprises the steps of producing ions, causing the introduction of said ions into the space between the poles of the quadrupole mass filter and causing the transmission of only those ions of a selected mass-to-charge ratio through the space between said poles, the improvement comprising the use of an electric field separation means adjacent at least one of the ends of said poles, said field separation means comprising a shield composed of a material which is a good dielectric and a further material applied to said good dielectric material which functions substantially as a high dielectric to AC electric fields and substantially as a conductor to substantially DC electric fields, said further material applied to said good dielectric material so as to allow said transmission of ions and to shield them during said transmission through said field separation means at least in part from the substantially DC electric fields.

25. A method in accordance with claim 24 wherein said further material which is providing said shielding during said transmission of the ions has a resistance from end to end in the range of $10^5$ to $10^{11}$ ohms.

26. In a method for improving the efficiency of injection and/or transmission of ions passing through quadrupole mass filters which comprises the steps of producing ions and transmitting said ions into, through and from the region between the poles of the quadrupole mass filter, the improvement comprising the use of field separation means placed at at least one end of the mass filter pole structure, said field separation means comprising a supporting structure composed of a good dielectric material and a further conductive material applied thereto so that said field separation means functions substantially as a high dielectric to the AC electric fields and substantially as a conductor to the substantially DC electric fields of the mass filter, said field separation means configured to permit said transmission of ions with said further substance applied so as to shield the ions in said transmission at least in part from said substantially DC electric fields, the geometries of the arrangement being such as to make the AC electric fringe fields at a given relative field strength in space extend relatively farther away from the ends of the mass filter pole structure than the DC electric fringe electric fields wherein the relative electric fringe field strength is defined as the strength of the electric field at a given point divided by the strength of the corresponding electric field within the mass filter electrode structure.

27. A method in accordance with claim 26, wherein said further material comprises a layer applied to said good dielectric material.

28. A method in accordance with claim 26 wherein said layer from end to end has a resistance in the range of $10^5$ to $10^{11}$ ohms.

29. A method in accordance with claim 28, wherein said resistance is in the range of $10^6$ to $10^8$ ohms.

30. A method in accordance with claim 29, wherein said layer comprises carbon.

* * * * *